United States Patent [19]

Cyphelly

[11] 4,164,240

[45] Aug. 14, 1979

[54] DEVICE FOR LOW-LOSS VARIATION OF FLOW FROM A POSITIVE DISPLACEMENT PUMP BY PERIODIC INTERRUPTION OF THE FLOW

[76] Inventor: Ivan J. Cyphelly, Neuhaus, 8128 Hinteregg, Switzerland

[21] Appl. No.: 762,570

[22] Filed: Jan. 26, 1977

[30] Foreign Application Priority Data

Jan. 27, 1976 [CH] Switzerland ..... 994/76

[51] Int. Cl.[2] ..... F16K 11/02

[52] U.S. Cl. ..... 137/887; 137/624.15; 137/468

[58] Field of Search ..... 137/624.13, 624.15, 137/565.1, 565.2, 625.32, 82, 83, 887; 417/440, 442

[56] References Cited

U.S. PATENT DOCUMENTS

| | | | |
|---|---|---|---|
| 134,562 | 12/1942 | Murphy | 239/601 |
| 687,041 | 11/1901 | Logon | 137/625.32 |
| 1,658,645 | 2/1928 | Mcgee | 137/601 |
| 1,668,271 | 5/1928 | Fisk | 239/DIG. 1 |
| 1,990,263 | 2/1935 | Benedek | 417/506 |
| 2,729,167 | 1/1965 | Links | 417/206 |
| 2,859,768 | 11/1958 | Teague, Jr. | 137/468 |
| 3,211,182 | 10/1965 | Gyurik et al. | 137/625.64 |
| 3,316,846 | 5/1967 | Bender | 137/624.15 X |
| 3,548,876 | 12/1970 | Viersma | 137/625.63 |
| 3,919,923 | 11/1975 | Haigh | 137/82 |

FOREIGN PATENT DOCUMENTS

| | | | |
|---|---|---|---|
| 2519366 | 1/1976 | Fed. Rep. of Germany . | |
| 370319 | 2/1907 | France . | |
| 27752 | of 1912 | United Kingdom | 137/625.32 |

*Primary Examiner*—Martin P. Schwadron
*Assistant Examiner*—A. Michael Chambers
*Attorney, Agent, or Firm*—Browdy and Neimark

[57] ABSTRACT

The flow of fluid from a constant output positive displacement pump entering an outlet line directed to a consumer may be varied by periodically interrupting this flow and directing the flow instead into a zero pressure pump reservoir. This interruption is accomplished by a rotary shutter which periodically and alternately opens and closes the line to the reservoir. The line from the pump flows into two nozzles opening into opposite sides of the rotary shutter and directed toward one another. The rotary shutter comprises a shaft with two raised ribs thereon positioned to simultaneously open or close both of the nozzles, thus hydrostatically balancing the shaft. The edges of the raised ribs have cutting angles thereon for milling the opening of the nozzles during operation to produce an optimum gap between the rotary shutter and the nozzles. Only when the nozzles are closed is the flow directed into the outlet line to the consumer. An improved shape for the nozzle openings with respect to the rotary shutter edge is also disclosed.

6 Claims, 10 Drawing Figures

DEVICE FOR LOW-LOSS VARIATION OF FLOW FROM A POSITIVE DISPLACEMENT PUMP BY PERIODIC INTERRUPTION OF THE FLOW

FIELD OF THE INVENTION

The present invention relates to a device for low-loss variation of flow from a positive displacement pump by periodically and alternately interrupting the flow to the consumer or load and directing the flow into a zero pressure reservoir, and more particularly to such a device wherein the interrupting means is a rotary shutter which opens and closes the line to the reservoir as the shutter rotates.

BACKGROUND OF THE INVENTION

Devices are known in the prior art for regulating the volume rate of delivery of a fluid from the discharge side of a pump by intermittently opening and closing a fluid flow interrupter in communication with the discharge and suction sides of the pump, with a non-return valve disposed downstream of the communication between the flow interrupter and the discharge side of the pump and communicating between the discharge side of the pump and the load. U.S. Pat. No. 3,316,846 is a device of this type which uses a rotating cylinder for opening and closing a line to return the fluid to a pump reservoir. However, the cylinder is hollow and the fluid is fed outwardly through the cylinder and into a return line.

U.S. Pat. No. 1,990,263 teaches a similar valve arrangement, downstream from a pump, on which raised ribs on a rotating shaft open and close access to a return line. There is only a single outlet directing the fluid from the pump toward the shaft.

German Offenlegungsschrift No. 2,519,366 teaches a similar arrangement with a single discharge with a shaft having a raised rib thereon which opens and closes the opening as the shaft rotates.

U.S. Pat. No. 2,729,167 and French Pat. No. 370,319 also show rotating valves.

All of these known devices however are suitably only for use at low pressures. At high pressures the leakage losses as well as noise production reach intolerable values.

SUMMARY OF THE INVENTION

Accordingly, it is an object of the present invention to make a device of the type generally known in the prior art which is suitable for use at high pressures.

It is another object of the present invention to make such a device wherein the efficiency is increased by reducing leakage losses.

It is still another object of the present invention to produce such a device wherein the noise generation is substantially reduced, particularly when operated at high pressures.

In accordance with the present invention this is achieved by providing two return line nozzles mounted opposite one another and directed toward one another on opposite sides of the rotary shutter and wherein the rotary shutter, disposed in a bore in a body of the valve arrangement, is provided with a shaft and two raised ribs, or cam lobes, disposed such that the ribs temporarily cover and thereby close both nozzles simultaneously so that the shaft of the rotary shutter is hydrostatically balanced.

The objects of the present invention are further achieved by the feature that the edges of the raised ribs are provided with cutting angles so that the openings of the return line nozzles are milled during operation and thereby produce an optimum gap between the rotary shutter and the return line nozzles.

This design allows simple creation of the minimum play required to reduce leakage between the nozzles and the shutter. The nozzles are advantageously made of a material with a greater coefficient of expansion than that of the valve housing material, and are supported in such a manner that the ends of the nozzles approach the shutter when heated. At the maximum operating temperature, the milling action of the shutter thus forms a minimum gap which ensures minimum leakage at the low viscosity of the operating fluid. At low temperatures, however, the gap expands and yet the frictional losses are still kept within acceptable limits in spite of the higher viscosities which the working medium then exhibits.

It has also been found that the shape of the bore of the nozzle is important in reducing noise and vibration. The round hole is the most satisfactory shape for the nozzle opening from the manufacturing engineering standpoint, but does not produce an optimum solution from the noise generating standpoint, although the latter is somewhat better than the abrupt opening or closing by the edge of the shutter often employed in known designs. Shapes for the nozzle opening which gradually taper or expand in the closing or opening direction ensure chatter-free milling of the shutter and have proven to be a low noise design.

BRIEF DESCRIPTION OF THE DRAWINGS

The following is a further explanation of an embodiment of the subject of the present invention with reference to the drawings, in which:

FIGS. 4*a* and 4*d* show various shapes of the nozzle opening from the milling engineering and acoustical standpoints, in terms of the surface which is generated.

BRIEF DESCRIPTION OF PREFERRED EMBODIMENTS

Figure 1:
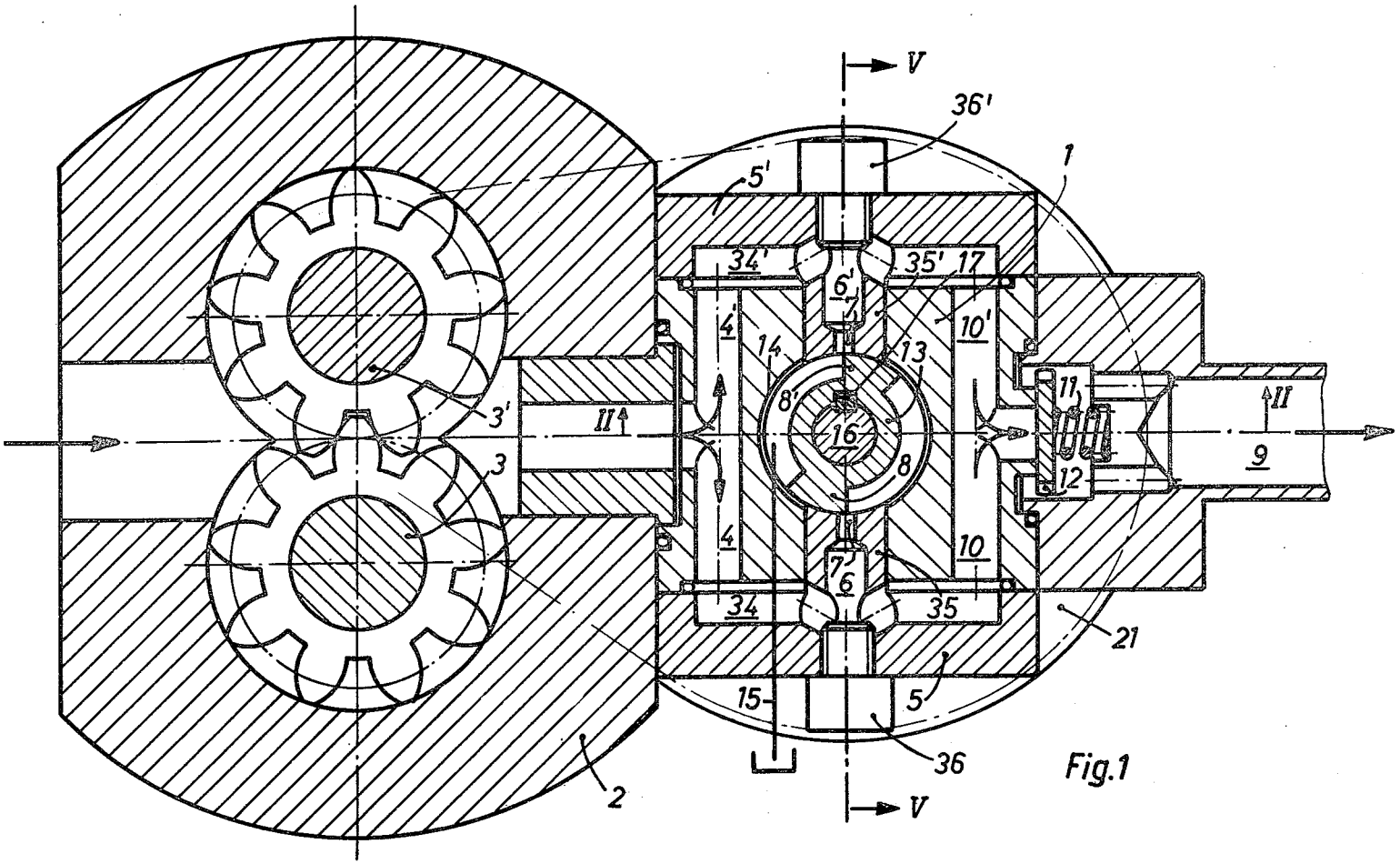
FIG. 1 is a cross section through the device with the valve arrangement at right angles to the shaft axis and through a pump flanged to it along line I—I in FIG. 2.
Figure 2:
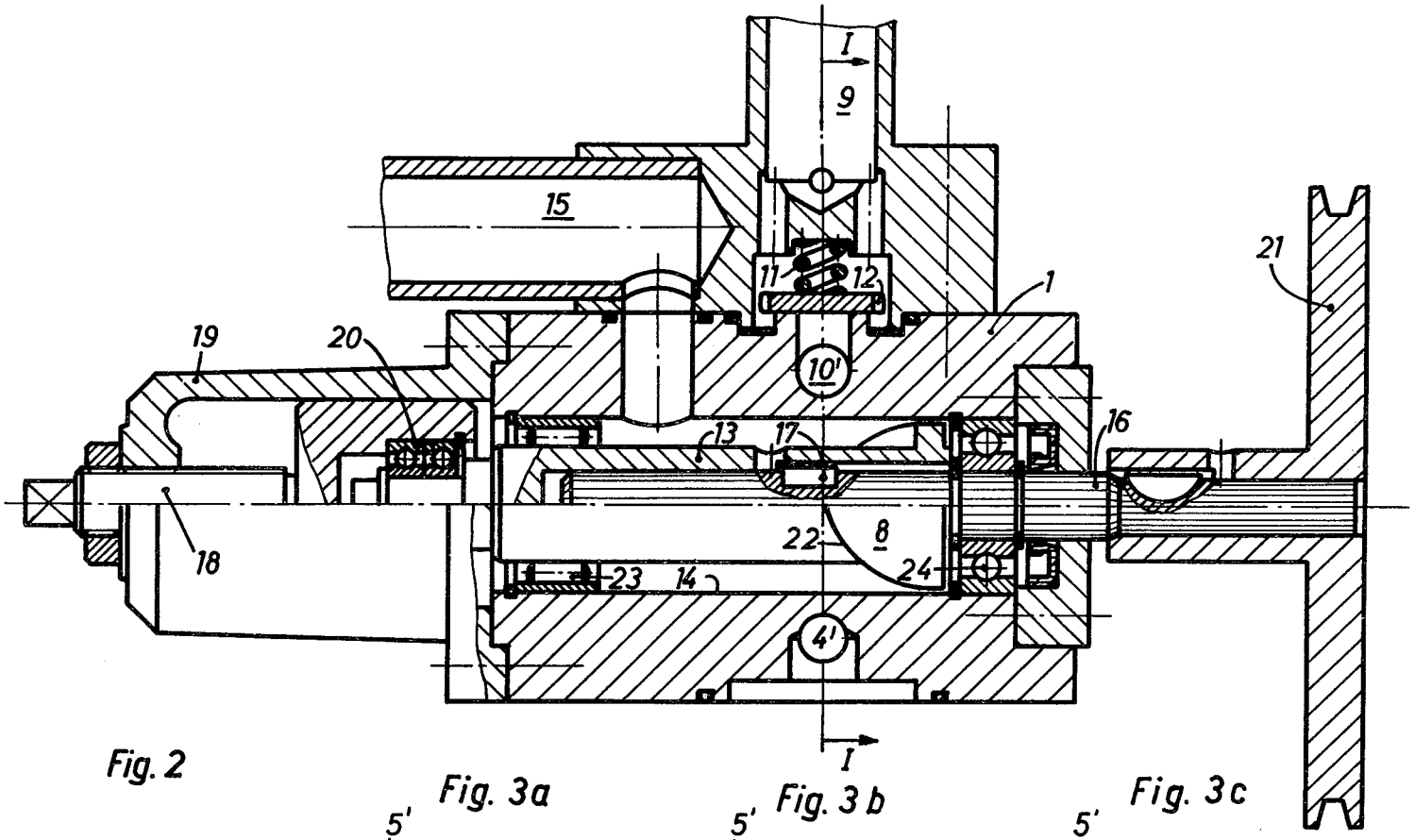
FIG. 2 is a cross section along line II—II in FIG. 1, i.e., through the shaft axis.
Figure 5:
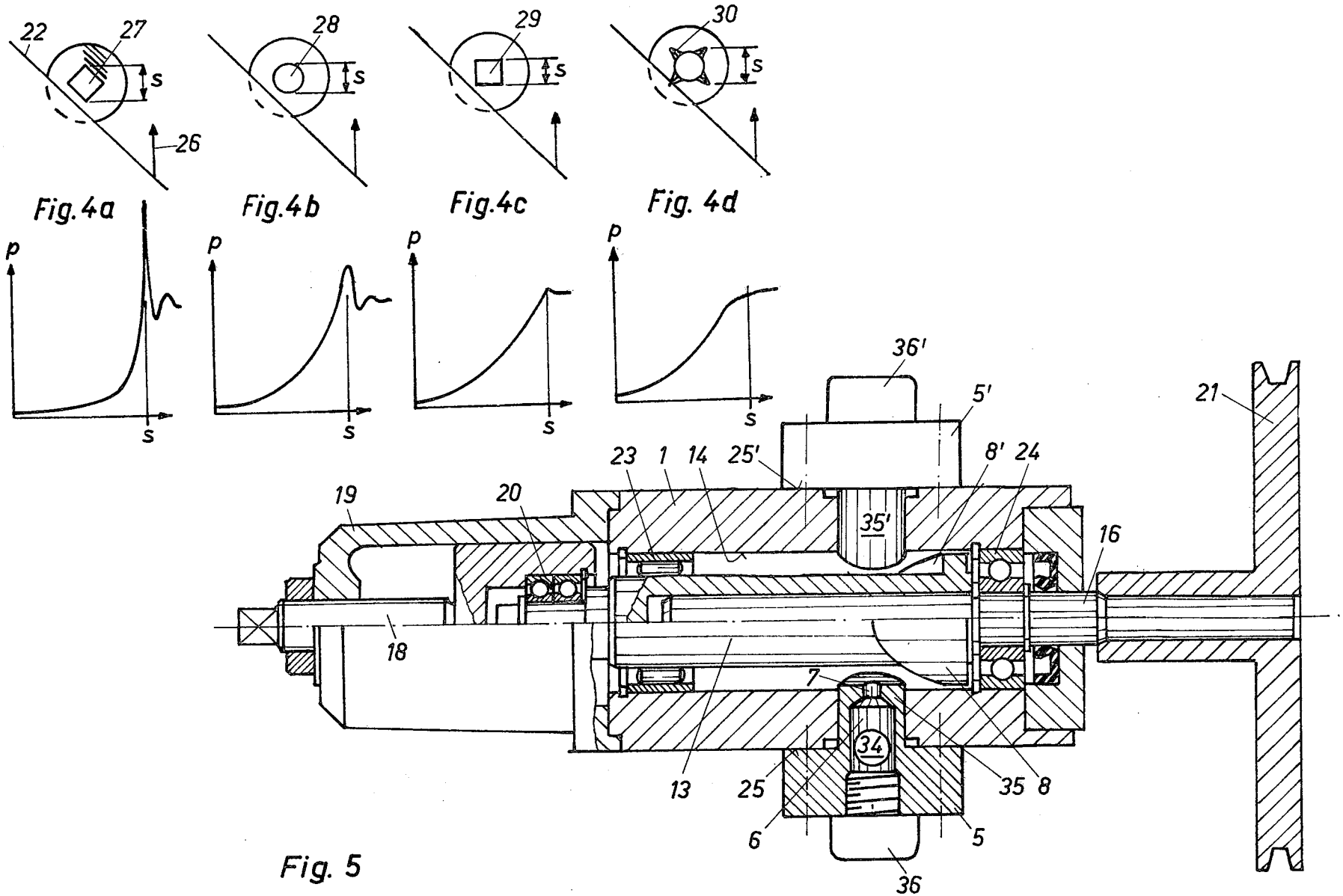
FIG. 5 is a cross section along line V—V in FIG. 1.

FIGS. 1, 2 and 5 show the present device as mounted on a gear pump. A valve housing 1 is firmly attached to a pump body 2 by means of screws (not shown). A gear pair 3,3' of the gear pump forces fluid toward the valve housing. The valve housing contains connecting bores 4,4' which divide the flow of fluid from the gear pump into two portions each traveling in opposite directions. Connecting bores 4,4' lead to passageways 34,34' formed between nozzle covers 5,5' and valve housing 1. Nozzles 35,35' are integral with nozzle covers 5,5' and contain cavities 6,6' and nozzle openings 7,7' communicating with passageways 34,34'. Cavities 6,6' are terminated at their outer ends by plugs 36,36' screwed into nozzle covers 5,5'. Nozzles 35,35' are directed into valve bore 14 formed in valve housing 1. The nozzles 35,35' are disposed on opposite sides of the valve bore 14 and are directed toward one another. Coaxially within the valve bore 14 is a drive shaft 16 connected by a key 17 to valve body 13. Shutters 8,8' in the form of raised ribs or cam lobes are formed on the surface of the valve body 13 and serve to open and close the nozzle openings 7,7'. The shutters 8,8' are so disposed on opposite sides of the valve body 13 so as to simultaneously open and close both nozzle openings 7,7', thus hydrostatically balancing the shaft.

On the outlet side of the valve housing is a load connection 9 which is connected to passageways 34,34' by connecting bores 10,10'. A check valve 12, tensioned by a spring 11, is placed in the load connection 9.

In operation it can be seen that the stream of fluid emitting by gear pair 3,3' of the gear pump is squeezed through connecting bores 4,4' into passageway 34,34', cavity 6,6' and thence to nozzle openings 7,7' nozzles 35,35'. If the nozzle openings 7,7' are closed by shutters 8,8', the fluid stream finds its way into load connection 9 via connecting bores 10,10' and check valve 12. The tension exerted by spring 11 is overcome by the pressure in the line when nozzle openings 7,7' are closed by shutters 8,8', thus allowing flow of the fluid through the load connection 9. However, if the shutter aperture is open the fluid stream flows into the space between the valve body 13 and valve housing 1, within valve bore 14, whence it is lead away at zero pressure via a reservoir line 15, as can more clearly be seen in the cross section in FIG. 2.

FIG. 2 also shows a mechanism for adjusting the time the shutter is open or closed. Valve body 13, with shutter 8,8', is axially displaceable on a drive shaft 16 and is connected with the latter only by means of a key 17 which transmits the torque. Adjustment of the axial position is accomplished by means of a spindle 18, meshing with a thread on a cover 19 which is screwed onto valve housing 1, wherein the connection with rotating valve body 13 is accomplished by means of a roller bearing joint 20. This type of connection is fully described in German Offenlegungsschrift No. 2,519,366 discussed hereinabove and is hereby incorporated by reference. Instead of spindle adjustment, hydraulic operation can be employed, for example by pressure regulation or constant current regulation or by electrical or mechanical actuation, to position the valve body precisely, as would be the case for a simple two-way slide valve. The interruption frequency, i.e., the frequency of closing or opening, is determined by the rpm of drive shaft 16, which is driven through a pulley drive by pump shaft 3'. The acoustic and efficiency conditions which are most satisfactory are provided by appropriately selecting the size of pulley 21.

FIG. 2 also shows the shutter edge 22 of valve body 13. The valve body is mounted at one end in a needle bearing 23, while drive shaft 16 is supported in a ball bearing 24.

Figure 3C:
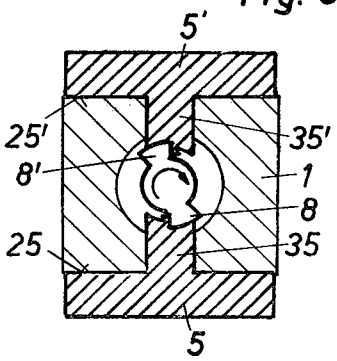
FIGS. 3*a* and 3*c* represent schematically the effect of the expansion of the nozzle on the formation of the gap between the end of the nozzle and the shutter as the temperature increases.
Figure 3B:
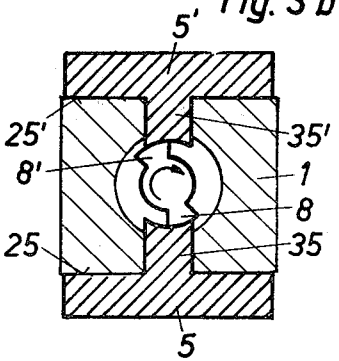
Figure 3A:
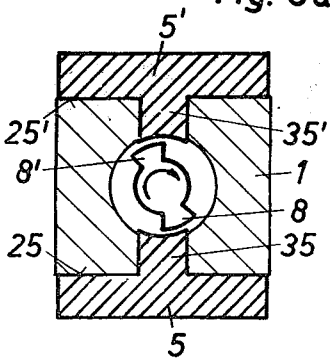

The operation of a thermal gap adjustment as provided in the present device is shown in FIGS. 3*a* to 3*c*. Nozzle covers 5,5' are supported on lateral surfaces 25,25' of valve housing 1, so that the difference between the coefficients of thermal expansion of the nozzle and housing is effective over the entire nozzle length. The nozzles are installed in a cold condition, with play relative to shutters 8,8' (FIG. 3*a*), and valve operation is started. When a certain temperature is reached, the shutters mill away the nozzle tips (FIG. 3*b*) until the highest operating temperature is reached (FIG. 3*c*). Any lower temperature then corresponds to a given operating gap, whereby minimization of frictional or leakage losses is achieved over the entire temperature range. This design, with flanged nozzle support on the valve housing outside surfaces, also has the considerable advantage that, in the event of wearing away of or damage to the nozzle openings, the valve can be made as good as new by simply removing material from the nozzle cover area which rests on the housing on lateral surfaces 25,25'.

FIGS. 4*a* to 4*d* show the development of noise. In each of these figures, the nozzle opening shape is related to the pressure build-up process in chambers 6,6' during closing by shutter edge 22. Shutter edge 22 here moves in the direction of arrow 26.

According to FIG. 4*a*, the shutter edges are parallel to the edges of the hole of nozzle opening 27. Abrupt closure results in a high pressure peak, and chatter marks in the direction of movement result from "edge impact" during milling. In order to avoid this, needle bearing 23 of valve body 13 or ball bearing 24 of drive shaft 16 must be replaced by a sliding bearing, which has the disadvantage of less precise guidance. Unacceptable noise development characterizes this hole shape, which is found in almost all previous devices of the type described hereinabove.

In the embodiment according to FIG. 4*b*, round nozzle opening 28, thanks to its simplicity of manufacture, can be used in many cases when noise pollution restrictions are not too severe. The less abrupt closing phase produces a medium-sized switching or pressure peak.

The square shape of nozzle opening 29 shown in FIG. 4*c*, with its corner directed against shutter edge 22, nearly completely eliminates the switching pressure peak and is relatively simply produced by using a broach. The optimum for the periodic interruption of the flow must be found on the basis of this shape, since it constitutes the best combination of noise and efficiency.

A circular shape as shown in FIG. 4*b* can be improved from the standpoint of noise by several radial grooves 30 as shown in FIG. 4*d*. This procedure is delicate however, since it can easily destroy the hydrostatic balance at the shutter valve body. In addition, in case of any refinishing of the nozzle, the process must be repeated, and must be properly tuned to the flow from the pump. Nevertheless, from the noise standpoint, the best results can be achieved in this manner even though the effects on efficiency are often disadvantageous.

Accordingly, the optimum design for the bore of the nozzle is one which gradually expands and then tapers in the closing or opening direction.

As used throughout the present specification and claims the term "load" refers to any device to which is made the ultimate use of the fluid, as for instance, a fluid-operated device or any other fluid dynamic system in which fluid flow occurs, as for instance a lubrication system.

It will be obvious to those skilled in the art that various changes may be made without departing from the scope of the invention and the invention is not to be considered limited to what is described in the specification.

What is claimed is:

1. A valve arrangement for use in a system having an inlet line from a positive displacement pump, a first outlet line directed to a load and a second outlet line directed to a zero-pressure pump reservoir, comprising:

a fixed valve housing having a bore therein;

two nozzles passing through said valve housing and extending into opposite sides of said bore, the openings of said nozzles being directed into said bore diametrically toward one another;

means for directing flow from said inlet line to said two nozzles;

rotary shutter means coaxially positioned within said bore for periodically and alternately, as said rotary shutter means continuously rotates, closing both of said nozzles, simultaneously, and opening said nozzles to allow flow into said second outlet line, whereby the necessity for a sealing relationship of said shutter with said valve housing is eliminated; and means permitting flow from said inlet line into said first outlet line only when said nozzles are closed.

2. A valve arrangement in accordance with claim 1 wherein the end of each of said nozzles opposite the opening to said rotary shutter means is provided with flanges which rest upon two opposite flat areas of said valve housing, and wherein materials are chosen for said nozzles and said valve housing having such relative thermal expansion coefficients as to cause the width of the gap between said rotary shutter means and said nozzles to vary inversely with temperature, and wherein said rotary shutter means comprises a shaft and two shutters thereon positioned to simultaneously open or close both of said nozzles as said shaft rotates and wherein the edge of each of said shutters on the leading side in the direction of rotation of said shaft is provided with cutting angles whereby the ends of said nozzles opening into said bore are milled during operation as the gap decreases due to thermal expansion to produce an optimum gap between said rotary shutter means and said nozzles throughout operation.

3. A valve arrangement in accordance with claim 1, wherein said rotary shutter means comprises a shaft and two shutters thereon positioned to simultaneously open and close both of said nozzles as said shaft rotates and wherein the openings in said nozzles have a shape which gradually expands and then tapers as the leading edge of said shutter closes said openings.

4. A valve arrangement in accordance with claim 3, wherein said openings are rectangular with one corner of each opening facing the leading edge of said shutters.

5. A valve arrangement in accordance with claim 4, wherein said rectangular opening is a square opening.

6. A valve arrangement in accordance with claim 3, wherein the bores leading to said openings are cylindrical and further provided with lengthwise grooves in the vicinity of said opening, said grooved portion of said opening facing the leading edge of said shutters.

* * * * *